US005161491A

United States Patent [19]

Graves

[11] Patent Number: 5,161,491

[45] Date of Patent: Nov. 10, 1992

[54] INTERNAL COMBUSTION ENGINE

[76] Inventor: John G. Graves, 3107 Woodward Blvd., Tulsa, Okla. 74105

[21] Appl. No.: 540,270

[22] Filed: Jun. 19, 1990

Related U.S. Application Data

[63] Continuation-in-part of Ser. No. 371,258, Jun. 26, 1989, Pat. No. 4,960,369.

[51] Int. Cl.[5] ..... F02B 53/00

[52] U.S. Cl. ..... 123/45 A; 92/33

[58] Field of Search ..... 123/45 A, 56 C, 51 A, 123/51 B; 92/33

[56] References Cited

U.S. PATENT DOCUMENTS

| | | | |
|---|---|---|---|
| 855,256 | 5/1907 | Morey | 92/33 X |
| 1,150,832 | 8/1915 | Blackwood | 92/33 |
| 1,243,554 | 10/1917 | Rasmussen | 92/33 X |
| 1,613,136 | 1/1927 | Schieffelin | 123/45 A X |
| 2,245,457 | 6/1941 | Brassell | 74/57 |
| 2,470,888 | 5/1949 | Degner | 74/57 |
| 2,612,312 | 9/1952 | Clarke | 417/538 X |
| 3,036,810 | 5/1962 | Conrad et al. | 174/57 X |
| 3,061,175 | 10/1962 | Schmidt | 417/434 |
| 3,388,603 | 6/1968 | Clark | 74/57 |
| 4,180,028 | 12/1979 | Richter | 123/45 A |
| 4,362,478 | 12/1982 | Huckaby | 417/434 |
| 4,479,759 | 10/1984 | Zeitz | 417/500 |
| 4,854,837 | 8/1989 | Cordray | 417/500 |

FOREIGN PATENT DOCUMENTS

| | | | |
|---|---|---|---|
| 122585 | 1/1919 | United Kingdom | 92/33 |

OTHER PUBLICATIONS

Design News, Dec. 1, 1986, pp. 62-64 "Sinusoidal Cam Engine Gives High Torque at Low RPM".

*Primary Examiner*—Michael Koczo
*Attorney, Agent, or Firm*—Head & Johnson

[57] ABSTRACT

An internal combustion engine which includes a system to deliver a combustible mixture to a cylinder, ignite the combustible mixture and exhaust the mixture after ignition. The internal combustion engine comprises at least one piston capable of reciprocating within the cylinder, each piston having an interior cylindrical surface and a continuous, wave-shaped groove recessed into the interior cylindrical surface. A rotatable crankshaft passes concentrically through the cylinder and through the piston. At least one crank member extends radially from the crankshaft and is received in the wave-shaped groove. The piston is prevented from rotating while being allowed to reciprocate so that the force of combustion causes movement of the piston thereby causing rotation of the crank member and rotation of the crankshaft.

2 Claims, 4 Drawing Sheets

INTERNAL COMBUSTION ENGINE

This Application is a continuation-in-part of U. S. patent application Ser. No. 07/371,258, filed Jun. 26, 1989, entitled "Rotatably Driven Positive Displacement Pump," U.S. Pat. No. 4,960,369.

BACKGROUND OF THE INVENTION

1. Field of the Invention

The present invention relates to an internal combustion engine having reciprocating pistons operating within a cylinder or cylinders.

2. Prior Art

The reciprocating internal combustion engine has for nearly a century mechanized the industrial world. However, the conservation of energy has forced the search for lighter and more efficient engines. Manufacturers, in particular automotive engine manufacturers, have focused more on refinements of old designs and technically complex engines, and have even recently attempted to develop two-cycle engines for automotive use despite the notorious emission problems inherent in two-cycle engines.

The present invention provides a lightweight, technically simple, high power-to-weight ratio engine with relatively few parts. The arrangement of a plurality of pistons within a common cylinder provides for multiplication of work being done by each piston. Another benefit of the invention is the development of high torque at relatively low revolutions per minute. The invention of this disclosure may be provided with a conventional valve train. Alternatively, the engine may be provided with a rotor in each combustion chamber, affixed to the crankshaft, that cooperates with the intake and exhaust ports in each combustion chamber by closing and opening each port in proper time with the cycle of each piston, thereby eliminating conventional valves, lifters, push rods, cam shafts, and the like.

Another benefit of the provision of the rotor is its shielding of the spark plug electrodes from the cylinder chamber through most of the pistons' cycles, thereby extending the life and efficiency of the spark plug.

Another benefit of the present invention is an engine that provides a more uniform load on the crankshaft than a conventional reciprocating engine. In the four piston, four-cycle embodiment, this invention provides the equivalent of eight power cycles for each crankshaft revolution compared to a conventional four cylinder four cycle engine that provides two power cycles for each revolution of the crankshaft. In the embodiments herein described, the arrangement of pistons alternately moving away from and towards another, provides in a four-cycle embodiment, pistons that are subject to a power cycle half the time, and in a two-cycle embodiment, pistons that are subject to a power cycle each time axial movement direction of the piston reverses.

Another benefit of the invention is the provision of an engine that allows the revolutions of the crankshaft and piston cycle relationship to be modified or varied by changes in the pattern and/or frequency of the interior and exterior grooves in the piston. This benefit is useful in that four-cycle or two-cycle engines with various torque/revolution relationships, as necessitated by different applications or uses of engines may be provided by the basic design of this invention.

SUMMARY OF THE INVENTION

A plurality of axially displacable tubular pistons are reciprocable within a cylinder. Rotatably received within the cylinder and passing through each piston is a crankshaft. Extending from the crankshaft within each piston is a crank member which extends within a groove in the internal surface of each piston. As combustion and expansion occurs within each cylinder, the force created thereby axially displaces each piston causing rotation of the crank members and the crankshaft.

DETAILED DESCRIPTION OF THE PREFERRED EMBODIMENTS

Figure 1:
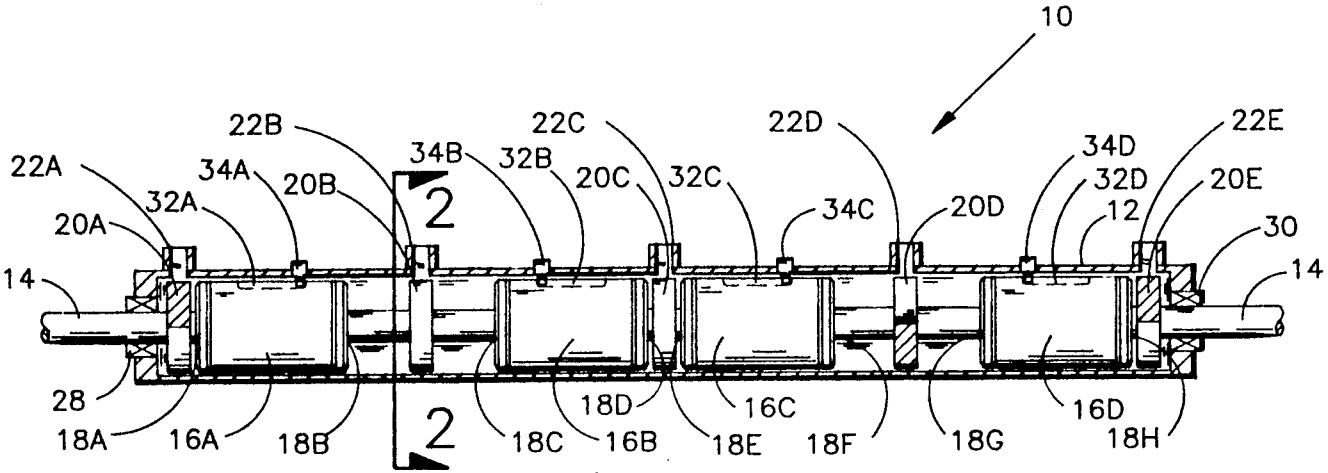
FIG. 1 is an elevational view of one embodiment of an engine of this disclosure.

Referring to FIG. 1, a four-cycle, four piston engine 10 is shown. The engine 10 includes a tubular cylinder 12. Rotatably received within the cylinder 12 is a crankshaft 14. Slideably received in the cylinder 12 are a plurality of pistons each of which is capable of reciprocal movement. The pistons are identified by numerals 16A–16D. On each end of each piston is an opening identified by numerals 18A–18H. The openings 18A–18H are slightly larger than the diameter of the crankshaft 14 which is slideably and rotatably received through each piston 16A–16D.

Extending radially from the crankshaft 14 are a plurality of rotors identified by numerals 20A–20E. Each of the rotors 20A–20E have an essentially triangular opening, identified by numerals 21A–21E, which can be seen in FIG. 2. Formed in the cylinder 12 are a plurality of intake ports, identified by the numerals 22A–22E. Also formed in the cylinder 12 are a plurality of exhaust ports, identified by the numerals 24A–24E, which may be seen in FIG. 2. The exhaust ports are not seen in the sectional view shown in FIG. 1. Also formed in the cylinder 12 are a plurality of spark plug receiving ports 26A–26E. When viewing FIG. 1, the spark plug ports 26A–26E are on the far side of the cylinder 12, out of view, but the location of ports 26As–26E may be seen in FIG. 2. Axial displacement of the crankshaft 14 is prevented by thrust bearings 28 and 30 on the ends of the cylinder 12.

The pistons are allowed to reciprocate within the cylinder. Each of the pistons 16A–16D is provided with a channel identified by numerals 32A–32D, in the piston external surface. The channels 32A–32D are axially aligned with and in the same plane as the crankshaft 14 in this embodiment, although other designs may be used. Received in each channel 32A-32D is a bearing, identified by numerals 34A-34D, which has an outer portion that extends outwardly through the wall of the cylinder 12 and is affixed thereto. Each of the bearings 34A-34D is stationary and thus prohibits rotation, while allowing the axial displacement, of each piston 16A-16D.

Figure 2:
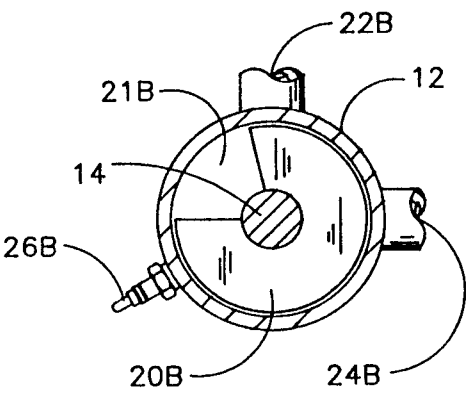
FIG. 2 is an enlarged cross-sectional view taken along line 2—2 of FIG. 1 of the rotor employed in the engine of FIG. 1.

The end of each piston and the interior walls of the cylinder combine to form a combustion chamber for each piston. As seen in FIG. 2, the rotor 20B, which is affixed to the crankshaft 14, cooperates with intake port 22B, exhaust port 24B, and spark plug receiving port 26B. As the rotor 20B rotates counterclockwise due to the rotation of the crankshaft 14, the rotor 20B will sequentially open, then close, the ports 22B, 24B and 26B to the interior of the cylinder 12 which forms the combustion chamber. It will be appreciated that the placement of the spark plug ports shields the spark plug electrodes through most of the cycles.

Figure 3:
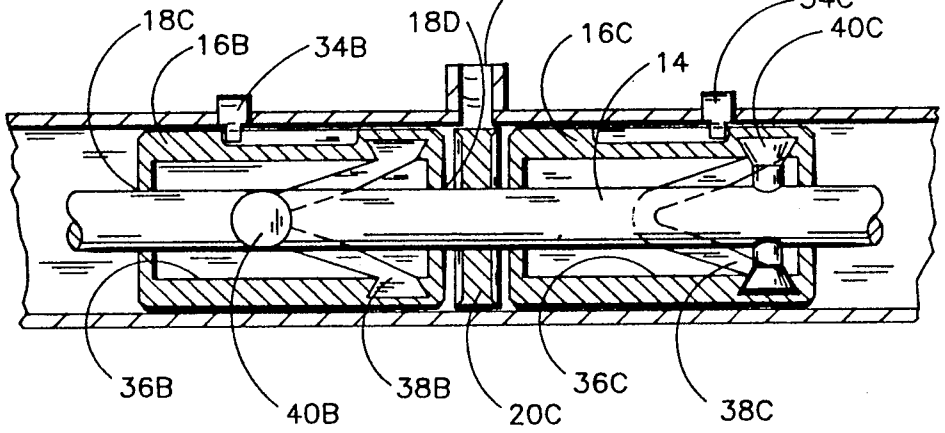
FIG. 3 is an enlarged cross-sectional view of a section of the engine of FIG. 1.

FIG. 3 shows the interior of pistons 16B and 16C, which are also representative of the other pistons. Each piston is essentially tubular having an interior surface 36B. Formed in the interior surface 36B is a sinusoidal wave-shaped groove 38B, although it will be recognized that other designs may be used. The groove 38B is continuous around the interior surface 36B of the piston 16B. Passing through the piston 16B is the crankshaft 14, which is rotatably and slideably received in the openings 18C and 18D. Extending from the crankshaft 14 is a crankmember 40B which extends into the groove 38B. The crankmember 40C extends likewise into the groove 38C of the piston 16C but the crankmember 40C is 90° out of phase from the crankmember 40B. Juxtaposed between the pistons 16B and 16C is the rotor 20C.

This arrangement is duplicated in the other pistons in that each piston 16A-16D has a corresponding interior grove, 38A-38D, and a cooperating crankmember 40A-40D. Therefore, the crankmember 40A received in the piston 16A is in the same position as the crankmember 40C in the piston 16C, and the crankmember 40D received in the piston 16D is in the same, 90° out of phase position as the crankmember 40B received in piston 16B. This provides pistons that alternately move away from, and thence toward, each other. More specifically, the pistons 16A and 16C of FIG. 1 will next move to the right while the pistons 16B and 16D simultaneously move to the left. When the pistons 16A-16D have so moved, they will then each reverse and return to the position shown in FIG. 1.

Figure 8:
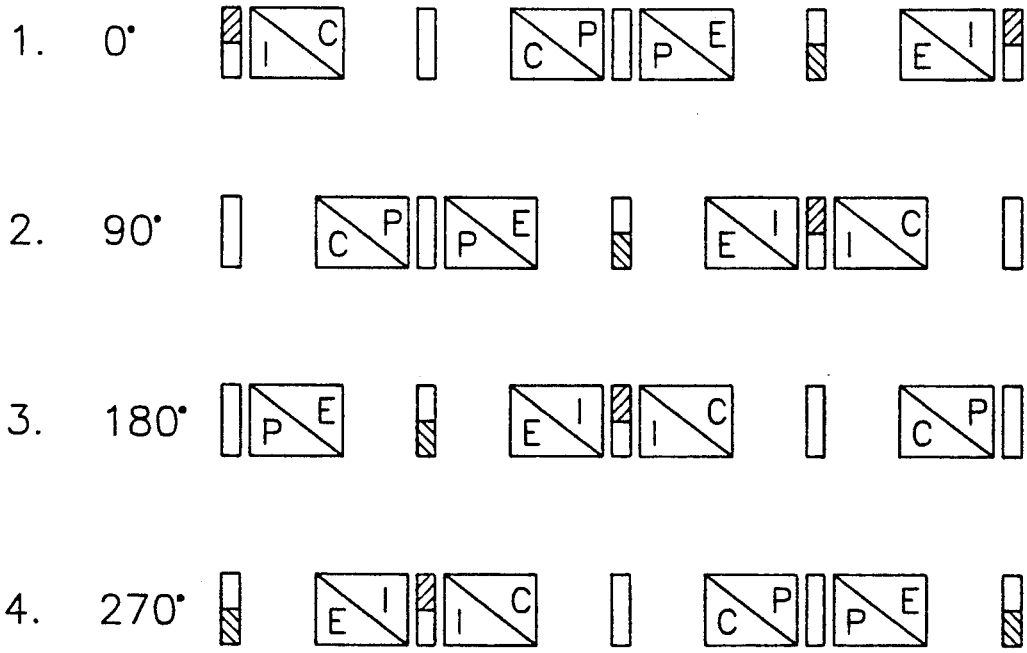
FIG. 8 is a diagrammatic representation of the reciprocation of the pistons and rotation of the rotors and crankshaft of FIG. 1.

The operation of the engine 10 is readily understood with reference to FIG. 8. FIG. 8 diagrammatically represents the axial, reciprocal movement of the pistons and the rotation of the rotors through one rotation of the crankshaft. The reference characters power (P), exhaust (E), intake (I) and compression (C) on the pistons in the diagram correspond to the cycle taking place on each pair of pistons adjacent to the reference character as it axially moves within the cylinder to the position represented on the next succeeding line of the diagram. Each line represents 90° of crankshaft rotation. Each piston performs two functions, such as a power stroke on one side and a compression stroke on the other side simultaneously.

An important provision of this invention is that changes in the design or frequency of either the external or internal grooves on the walls of the pistons allow the piston cycles-per-crankshaft rotation relationship to be altered according to the particular application of an engine provided by this invention. The embodiment of FIG. 1 provides a plurality of pistons where each piston will cycle four times in one rotation of the crankshaft. This embodiment allows a relatively great amount of power to be delivered to a relatively slowly rotating crankshaft as compared to a conventional four-cycle four cylinder engine.

Figure 4:
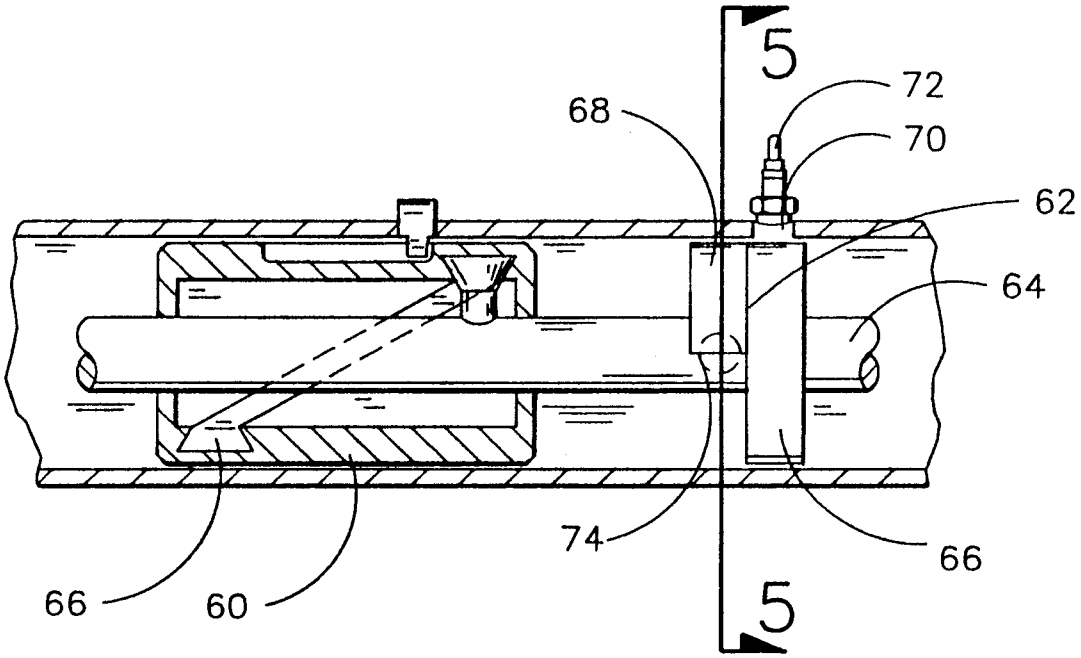
FIG. 4 is a cross-sectional view of another embodiment of a piston and rotor of the engine of this disclosure.

An alternate embodiment of the invention is a two-cycle engine. With reference to FIG. 4, a portion of a two-cycle engine is shown. A piston 60, a rotor 62 and a crankshaft 64 operate in principally the same manner as described above, that is, combustion and expansion forces the piston 60 to axially reciprocate thereby causing rotation of the crankshaft 64 and the accompanying rotor 62. However, the piston 60 has an internal groove 66 of a frequency one-half that of the internal grooves 38A-38D of the pistons 16A-16D of the engine of FIGS. 1, 2, and 3. Therefore, the first cycle of the piston 60, a cycle being the axial movement of the piston in one direction, causes the crankshaft 64 to rotate 180° instead of 90° as provided by the pattern of the grooves 38A-38D. A second cycle of the piston 60, its return to its first position, rotates the crankshaft 64 an additional 180°.

Figure 5:
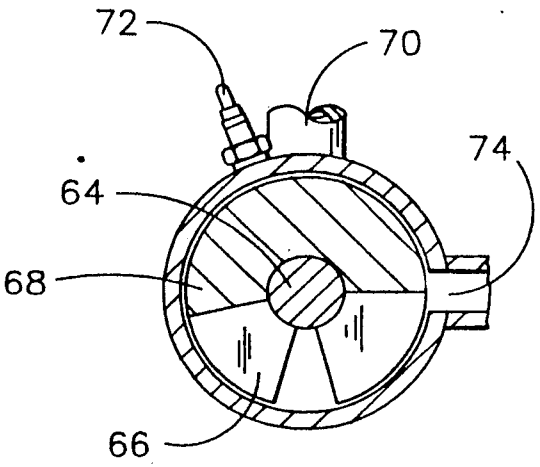
FIG. 5 is a cross-sectional view, taken along line 5—5 of FIG. 4, of the rotor of FIG. 4.

The rotor 62 of the two cycle embodiment may be comprised of an intake/ignition section 66 and an exhaust section 68, which cooperate with an intake port 70, a spark plug port 72, and an exhaust port 74 as shown in FIGS. 4 and 5. The intake port 70 and the spark plug port 72 are adjacent to each other in the same plane as the plane of the rotor section 66. The exhaust port 74 is in the same plane as the rotor section 68. Rotation of the rotor 62 will open and then sequentially close the ports 70, 72, and 74. This arrangement allows the timing of such port opening and closing to be determined by the design of the rotor sections 66 and 68.

Figure 6:
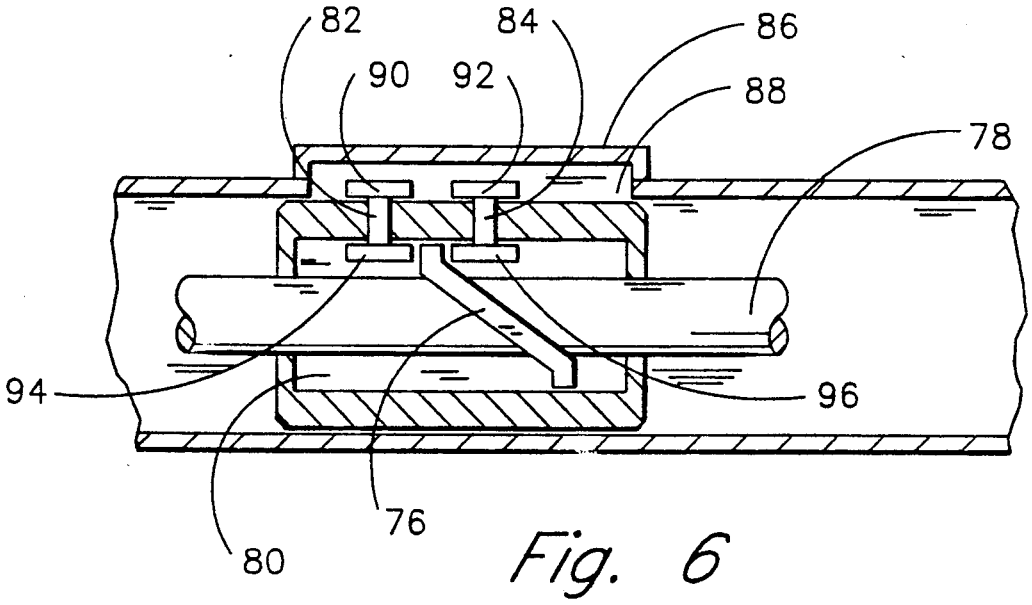
FIG. 6 is a cross-sectional view of another embodiment of a piston and crankshaft of this disclosure.

A further alternate embodiment of a crankshaft and piston arrangement of this invention is shown in FIG. 6. A cam 76 is affixed to a crankshaft 78. The cam 76 and the crankshaft 78 are received within a cylindrical piston 80. The piston 80 is provided with a pair of lugs 82 and 84. The lugs 82 and 84 extend exteriorially of the cylinder and are received in a carrier 86. The carrier 86 covers and seals a slot 88 in the cylinder. The outer end of the lugs 82 and 84 may be fitted with bearings 90 and 92 that travel axially in the carrier 86, thereby preventing rotation of the piston. The inner ends of the lugs 82 and 84 may be fitted with bearings 94 and 96.

As axial displacement of the piston 80 occurs, the force that the bearings 94 and 96 apply to the cam 76 is transferred to the crankshaft 78 and the crankshaft therefore rotates. The cam 76 may be as shown, or sinusoidal in shape.

Figure 7:
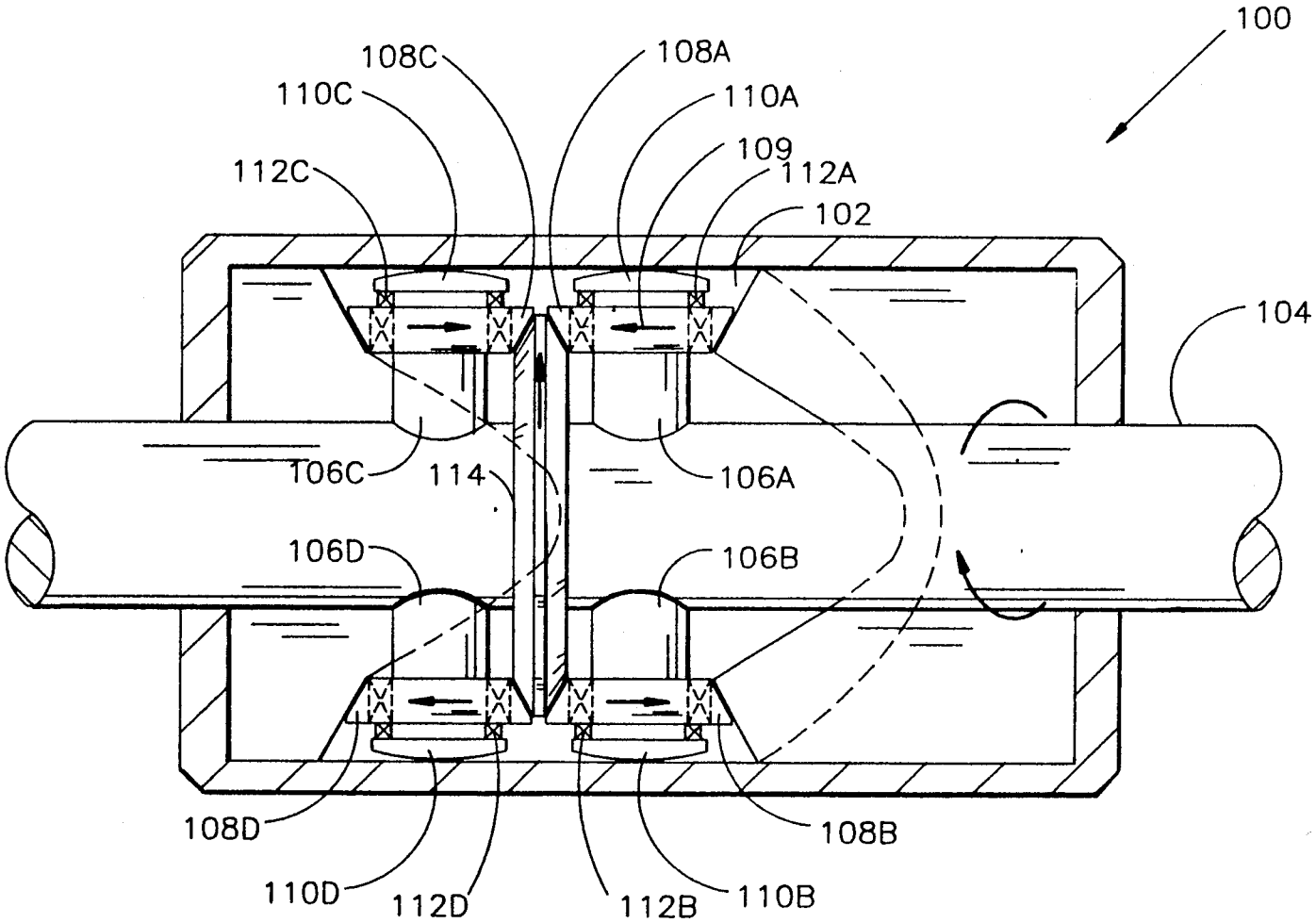
FIG. 7 is a cross-sectional view of another embodiment of a piston and crankshaft of this disclosure.

The problem of friction between the crankmembers and the grooves may be addressed in the following manner. FIG. 7 illustrates an embodiment of a piston comprising a crankshaft arrangement provided with bearings at the crank-groove contact. A piston 100 is provided with a groove 102 and concentrically receives a crankshaft 104 as previously described. The crankshaft is provided with four crankmembers 106A, 106B, 106C and 106D. Each crankmember is provided with a tapered bearing, identified by reference numerals 108A, 108B, 108C, and 108D. The outside end of each crankmember is provided with a cap, identified by reference numerals 110A, 110B, 110C, and 110D. Thrust bearings, identified by reference numerals 112A, 112B, 112C and 112D are provided between each tapered bearing 108A–108D and each cap 110A–110D. A tapered disc 114 concentrically receives the crankshaft 104, and is free to rotate about the crankshaft 104. The angle of the taper on the tapered disc 114 corresponds to the angle of the tapered bearings 108A–108D which corresponds to the angle of the groove 102. These angles compensate for the difference in circumferential distance around the groove path. As the piston 100 axially cycles, the force is converted into rotation of the crankshaft 104 through the bearings above described.

With reference to FIG. 7, as the piston 100 begins to move from the right to the left, the internal groove 102 forces the tapered bearings 108A–108D to rotate about the cranks 106A–106D, rolling along the groove surface, thereby rotating the crankshaft 104. The tapered bearing 108A rotates about the crank 106A in the direction of the arrow 109, while the tapered bearing 108C rotates about the crank 106C in the direction of its arrow, while the tapered disc 114 rotates about the crankshaft 104 in the direction of its arrow. The tapered disc 114 is free to rotate about the crankshaft 104 because the distance traveled by the tapered bearings in any revolution is greater than the circumference of the groove 102, due to the groove being wave-like, and the tapered disc 114 therefore is allowed to rotate at the rotation speed of the tapered bearings, thereby reducing frictional forces at this point of contact.

It should be understood that although the preferred embodiments described herein relate to internal combustion engines, the present invention might also be employed with other types of gas expansion or fluid pressure engines.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An internal combustion engine having means to deliver a combustible mixture to a cylinder, means to ignite said combustible mixture, and means to exhaust said mixture after ignition, which comprises: at least one piston capable of reciprocating within said cylinder, each said piston having an interior cylindrical surface and a continuous, wave-shaped groove recessed in said interior cylindrical surface; rotatable crankshaft means passing concentrically through said cylinder and through said piston; at least one crank member extending radially from said crankshaft and received in said wave-shaped groove; a disc extending radially from said crankshaft and freely rotatable therein, said disc terminating in a tapered end, and wherein said continuous wave-shaped groove is trapezoidal in cross section and wherein each said crank member terminates in a pair of rollers in parallel alignment which rotate in opposite directions and which travel within and engage said wave-shaped groove, said rollers also engaging said tapered end of said disc; and means to limit rotation of said piston while allowing reciprocal movement of said piston, whereby the force of combustion causes movement of said piston, thereby causing rotation of said crank member and rotation of said crankshaft.

2. An internal combustion engine having at least one piston capable of reciprocating within a cylinder wherein reciprocal movement of said piston is translated into rotational movement of a crankshaft that passes through said cylinder and piston, wherein said improvement comprises: at least one pair of parallel crank members extending radially from said crankshaft; a continuous wave-shaped groove recessed in an interior cylindrical surface of said piston; a roller extending from the end of each said crank member, said rollers in parallel alignment and which rotate in opposite directions and which travel within and engage said groove; and a disc extending radially from said crankshaft and freely rotatable therein, said disc terminating in a tapered end juxtaposed between said rollers and engaged therewith.

* * * * *